United States Patent [19]

Fales

[11] Patent Number: 5,036,557

[45] Date of Patent: Aug. 6, 1991

[54] PATIENT TRANSFER APPARATUS AND METHOD

[75] Inventor: Earl M. Fales, Portland, Oreg.

[73] Assignee: Transfer Ease, Inc., Portland, Oreg.

[21] Appl. No.: 749,653

[22] Filed: Jun. 28, 1985

Related U.S. Application Data

[63] Continuation-in-part of Ser. No. 686,603, Dec. 27, 1984, abandoned.

[51] Int. Cl.[5] ..... A61G 7/10

[52] U.S. Cl. ..... 5/81 R; 5/81 B; 5/508

[58] Field of Search ..... 5/61, 81 R, 81 B, 81 C, 5/89, 508; 128/134; 414/921

[56] References Cited

U.S. PATENT DOCUMENTS

| | | | |
|---|---|---|---|
| 3,329,978 | 7/1967 | Porter et al. | 5/81 R |
| 3,469,268 | 9/1969 | Phillips | 5/89 |
| 3,792,500 | 2/1974 | Swara, Sr. | 5/81 B |
| 3,927,430 | 12/1975 | Allen | 5/81 R |
| 4,012,799 | 3/1977 | Rutherford | 5/81 R |
| 4,274,168 | 6/1981 | Depowski | 5/81 B |

FOREIGN PATENT DOCUMENTS

| | | | |
|---|---|---|---|
| 155584 | 6/1982 | German Democratic Rep. | 5/81 R |

*Primary Examiner*—Michael F. Trettel
*Attorney, Agent, or Firm*—Eugene M. Eckelman

[57] ABSTRACT

A patient transfer apparatus and a method of using the apparatus to facillitate the transfer of a patient lying flat, from a first patient support such as a bed or table to a second patient support such as a stretcher, or vice versa. The apparatus includes a substantially rigid, planar board which bridges between the patient supports, and a stop secured to the bottom of the board which fits between the patient supports and abuts the side edge of the receiving patient support to prevent movement of the board as the patient is slid across it. The method relates to using the apparatus to slide a patient from one patient supporting surface to another, particularly on an incline where the first and second patient supports are at different heights.

4 Claims, 2 Drawing Sheets

PATIENT TRANSFER APPARATUS AND METHOD

This is a continuation-in-part of application Ser. No. 686,603, filed Dec. 27, 1984, now abandoned.

BACKGROUND OF THE INVENTION

This invention relates to an apparatus and method of moving a hospitalized patient, particularly one lying immobile, from a bed or table onto a stretcher, or vice versa. A patient transfer board is used to span between the two patient supporting surfaces, across which the patient is moved.

During hospitalization and other invalid patient care it is often necessary to move a patient who is lying flat from one place to another without any help from the patient and without disrupting the patient's horizontal position. This must be done without injury to the patient and with as much ease and comfort as possible. Oftentimes the patient may be in great pain, and accordingly, should not be moved over rough surfaces or with any jerky or sudden movements.

Previously it has been the practice to move such patients by several strong people simply lifting the invalid from one place to another. Of course, hand carried stretchers and wheeled stretchers are employed to assist in this movement, but still one has the problem of getting the patient onto the stretcher, and vice versa. The problem is complicated further if the bed and stretcher are at different heights. The same holds true for transferring the patient from the stretcher to an examination or operating table.

There have been developed several types of lifting apparatus such as hoists and cranes which can assist in the lifting of a patient. However, such apparatus is complicated and costly, and just as importantly, is time consuming to position and operate.

Background references disclose boards of metal or plastic being used for the transport of invalids. In one such reference, U.S. Pat. No. 4,067,079, a plastic slab is provided having a plurality of handholes around the preiphery of the slab, whereby several people may grasp the slab to lift a patient thereon. This is in distinction to the present invention in which no direct lifting is required. Further, the manner of loading a patient onto this prior apparatus is uncomfortable, as evidenced by FIG. 5 thereof.

Another reference, U.S. Pat. No. 4,048,681, discloses a lift board having many of the same features and limitations of the previous reference, but this device is for use only under the back and head and primarily involves the patient bending at the waist.

U.S. Pat. No. 3,329,978 discloses a bridging panel which extends between two adjacent surfaces at the same level. However, this device will not work if the surfaces are at different heights because it then looses its ability to stay in place frictionally. Another distinction is that there are no provisions for keeping a patient from sliding uncontrolled down the panel if it is on an incline. Further, the panel is made of metal, and thus it becomes sticky if a patient is wet, impeding its use.

Another reference, U.S. Pat. No. 3,792,500, discloses an apparatus for moving a dead body from a mortuary table to a wheeled cot. The device employs rollers, which would be very uncomfortable for a living person. Further, it has a sharp edge and a drop where the outer legs are attached, making it unsafe and uncomfortable, except for its disclosed purpose. The sharp corner is very apparent when the device is at an angle, such as is shown in FIG. 5 thereof. The sheet employed therein is a full body sheet, which is folded completely over the body. A live patient would feel uncomfortable if handled in this manner. Further, it is apparent that several such devices are needed to adequately support the body.

Accordingly, it is the general object of the present invention to provide a patient transfer board for sliding a lying patient from one patient support surface to a second patient support surface.

Another object is to provide an apparatus for sliding a patient up or down an incline when the patient supports are at different heights.

Yet another object is to provide comfortable support for the patient, even when moving him uphill or downhill, and to always avoid injury.

Another object is to provide a board made of a material which is slippery when either wet or dry, to provide patient comfort and ease of use in various circumstances.

A further object is to provide a method for transferring a patient using the present patient transfer board.

These and other objects and advantages and the manner in which they are achieved will become apparent as the specification and claims proceed, taken in conjunction with the drawings which illustrate the preferred embodiments.

SUMMARY OF THE INVENTION

In its basic concept the present invention is a patient transfer apparatus and method of using the apparatus to facilitate the transfer of a patient lying flat from a first patient support to a second patient support. The apparatus includes a substantially rigid, planar board which bridges between the patient supports, and a stop secured to the bottom of the board which fits between the patient supports and abuts a side edge of the second or receiving patient support to prevent movement of the board as the patient is slid across it. The method relates to using the apparatus to slide a patient from one patient supporting surface to another, particularly on an incline or slant where the first and second patient supports are at different heights.

DESCRIPTION OF THE PREFERRED EMBODIMENTS

Figure 1:
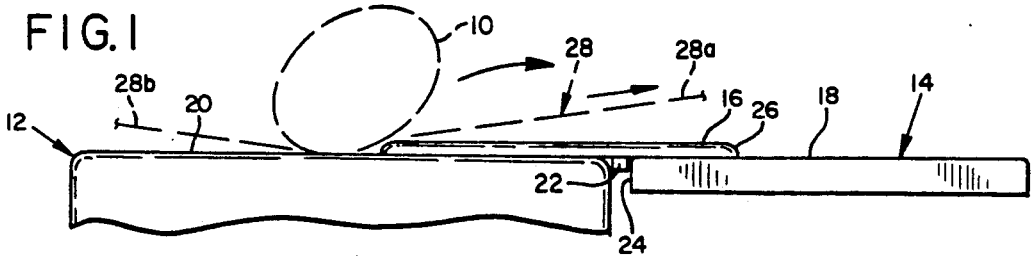
FIG. 1 is a fragmentary end view of two adjacent patient supporting surfaces, with the patient transfer apparatus of the present invention illustrated spanning between the surfaces, and also showing a patient in phantom line, and a flexible sheet in dashed line between the patient and the supporting surfaces.

In FIG. 1 is shown a patient 10 lying on a patient support or supporting surface generally indicated at 12. Such a supporting surface may be a bed or an examination table or operating table or the like. The instant invention is intended for use principally with a patient who is lying flat, in a prone or supine position, or on his or her side, it does not matter. However, the patient is one who is unable to effect their own movement to any substantial degree, and accordingly must be waited upon by attendants in order to move from one support to another. Furthermore, the patient is one who should not be moved substantially out of their flat position during the transferring process.

Shown adjacent the first patient support 12 is a second patient support or supporting surface 14, which may, for example, be a wheeled stretcher or the like. Of course it does not matter from which support to which other support the patient is being moved, save for purposes of discussion herein the initial location of the patient is referred to as the first patient support, and the resultant location of the patient is referred to as the second patient support.

Figure 5:
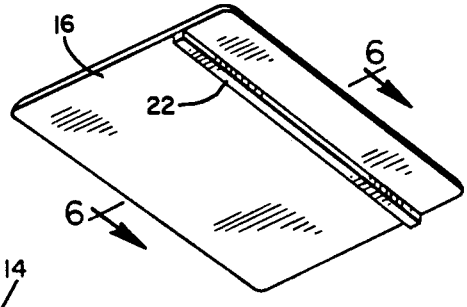
FIG. 5 is a bottom perspective view of the patient transfer apparatus of FIG. 1.

Spanning between the patient supports 12 and 14 is the patient transfer board of the present invention, the first embodiment of which is illustrated at 16. The ends of the patient transfer board rest on the top surfaces 18 and 20 of patient supports 14 and 12, respectively. Secured to the bottom of the board is a stop means, shown in the first embodiment as a cleat 22, which projects beneath the bottom of the board a sufficient distance to abut and bear against the side edge 24 of the receving or second patient support 14. FIG. 5 better shows the arrangement of the cleat, on the bottom of board 16, which preferably extends substantially the length thereof.

Figure 4:
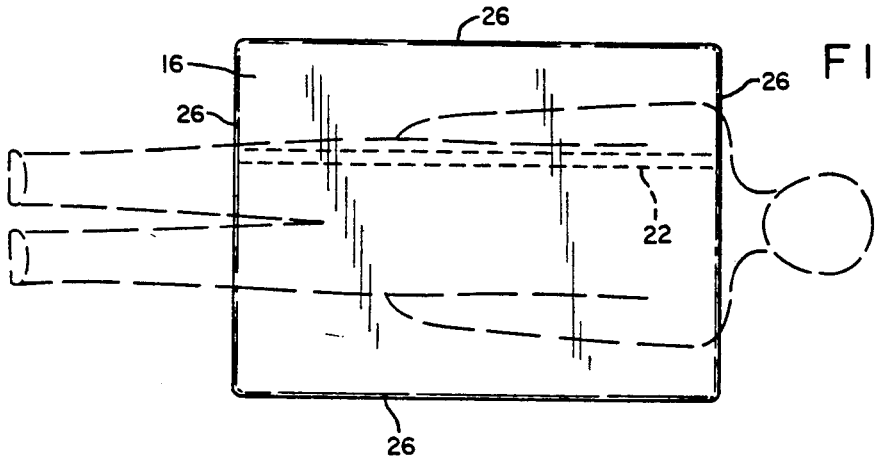
FIG. 4 is a top view of the patient transfer apparatus of FIG. 1, with a patient shown in phantom line.

Referring to FIG. 4, patient transfer board 16 is a substantially rigid, planar board having a length sufficient to support a majority of the weight of a patient between the patient's shoulders and hips. In an invalid patient, it is this bulk weight which is much more easily slid over a surface than lifted. The head and legs of the patient can be carried by other attendants as the patient is slid across the transfer board.

It is usually possible to move the patient supports substantially adjacent each other, but for those instances when it is not possible, the board must have sufficient strength to bear the weight of the patient. Also, the width of the board must be adequate to span such distances, leaving a substantial area to bear against the top surfaces of the patient supports on both sides. Further, it is the recommended procedure to roll a patient to one side, insert the wide side of the board under the patient, and then roll the patient back onto the board. Accordingly, a substantial width of board on at least one side of the stop means or cleat 22 is required for this maneuver.

The clothing and bedding of patients are often damp. A patient's skin or clothing have a tendency to stick to many materials that the board could otherwise be made of, causing the patient's skin to chafe. Accordingly, it is necessary that the board be made of a material, or have a coating, which has the property that it is slick whether it is wet or dry. Preferably, the board is made of ultra high molecular weight (UHMW) polyethelene, a material which has this property, in addition to being lightweight, yet rigidly strong and resilient.

Preferably, the upper edges of the board 16 are rounded at 26 for facilitating moving a patient thereonto. The patient need not encounter any uncomfortable sharp edges or the like.

Figure 2:
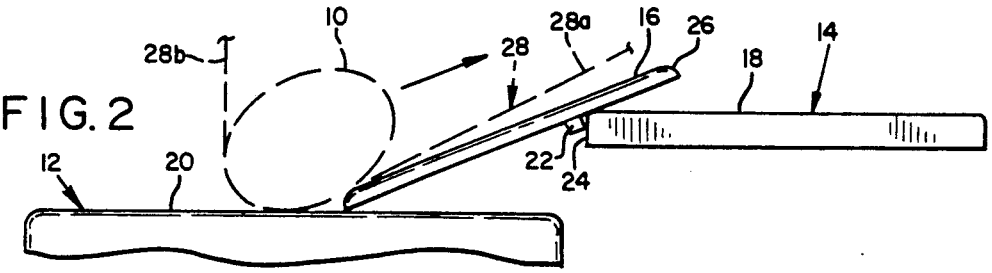
FIG. 2 is an end view similar to FIG. 1, illustrating moving the patient up an incline from one patient supporting surface to another at a higher level.
Figure 3:
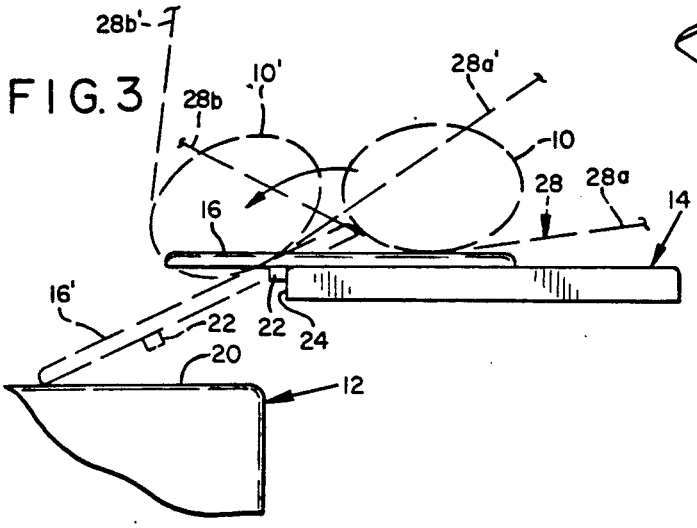
FIG. 3 is an end view similar to FIG. 1, illustrating moving a patient down an incline from one patient supporting surface to another at a lower level.
Figure 6:
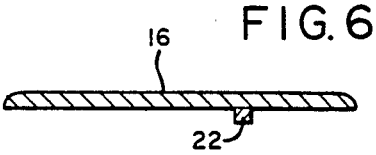
FIG. 6 is a section taken along the line 6—6 of FIG. 5.
Figure 8:
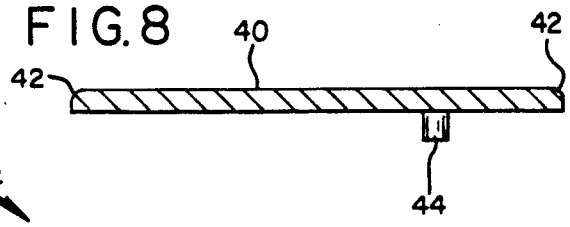
FIG. 8 is a section taken along the line 8—8 of FIG. 7.
Figure 7:
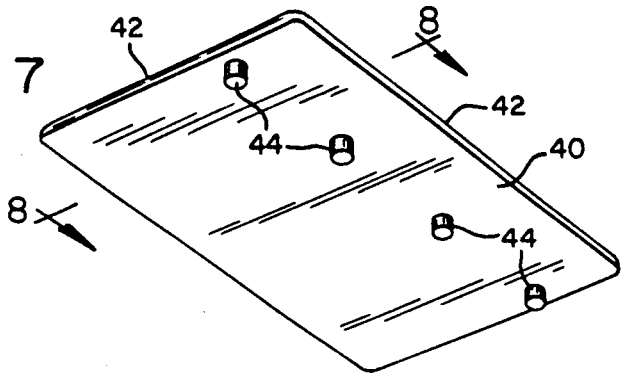
FIG. 7 is a bottom perspective view of a second embodiment of the present invention.
Figure 9:
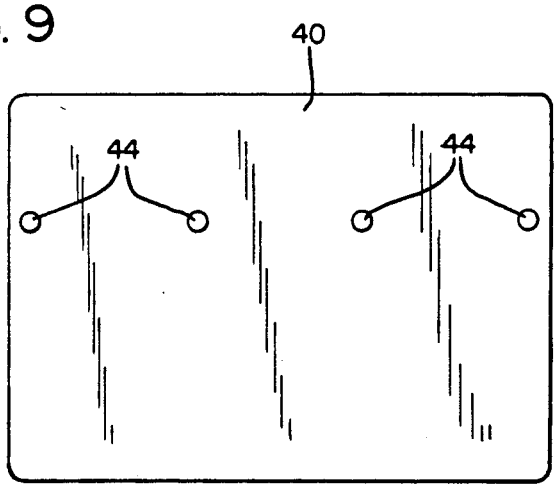
FIG. 9 is a bottom view of the apparatus of FIG. 7.
Figure 10:
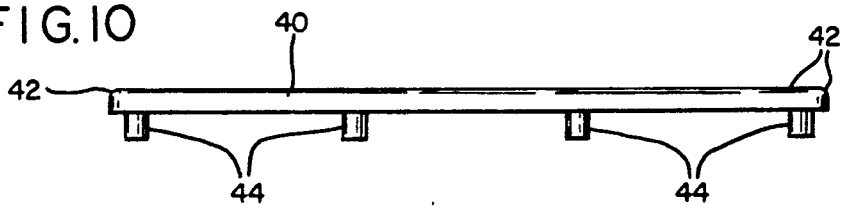
FIG. 10 is a longitudinal edge view of the apparatus of FIG. 7.

FIGS. 1, 2 and 3 illustrate a flexible sheet, shown generally at 28, which is positioned under patient 10, between the patient and board 16, and patient supports 12 and 14. This type of sheet is generally known as a turn sheet, and is placed in under a person's torso by rolling the patient onto his side, placing the folded turn sheet under the patient, and then rolling the patient over the fold and pulling the end of the turn sheet out straight. The ends of the sheet are denoted at 28*a* and 28*b*.

Sheet 28 is operable to exert a force on the patient by being pulled by an attendant for sliding the patient across the board. In FIG. 1 sheet 28*a* is pulled in the direction of the arrow, which pulls the patient onto the board and across it as the arrow illustrates.

In FIG. 2, the receiving patient support 14 is elevated above patient support 12. Thus, patient transfer board 16 is inclined. Cleat 22 still engages the side edge 24 of patient support 14. Sheet end 28*b* is held substantially upright from the lower side of the patient to prevent uncontrolled movement of the patient, while a sliding force is provided on the other end 28*a* of the sheet.

Accordingly, a method is provided for transferring a patient from a first patient support to a second patient support at a greater height. The method includes inserting the sheet beneath the patient so that an amount of the sheet sufficient for a handle extends on both sides of the patient, positioning the board to span the distance between the patient supports with the stop engaging the side of the second patient support, supporting the lower side of the patient by holding the sheet on that side substantially upright, supporting the head and legs of the patient, moving the patient across the board by pulling on the upper side of the sheet to slide the patient upwardly, and removing the board and the sheet from under the patient when the patient is on the second support surface.

When the patient is pulled partially up the board 16, the majority of the weight of the patient overcenters the pivoting point of the board and the lower side of the board tips upwardly, parallel with the second support surface. Thus, the patient is pulled off straight onto the second support surface, rather than having to go over a sharp corner.

FIG. 3 illustrates lowering a patient down from a first patient support 14 to a second patient support 12. As before, the wide side of board 16 is inserted beneath the patient, as is sheet 28. Sheet end 28*b* is pulled until the patient is at the edge of patient support 14. At that point the board tips and slides to the inclined position denoted by 16'. The lower edge of the board abuts patient support 12. At this point the patient begins to slide downwardly, so sheet end 28*b*' is held substantially upright to prevent uncontrolled movement of the patient, while another attendant holds sheet end 28*a*' and allows the patient to descend slowly.

FIGS. 7–10 illustrate a second embodiment of the patient transfer board of the present invention. Board 40 is substantially the same size and shape and preferably made of the same type of material as board 16. The edges are rounded at 42 so that the board may be comfortably placed in under the patient. The stop on the underside of the board 40 of this embodiment is a plurality of posts 44 which are attached in a line along the length thereof, in a similar position to cleat 22 of board 16. Preferably, there is a post adjacent each end of the board for stability, and other posts equally spaced therebetween as needed for strength. The preferred manner of attaching the posts, wherein both the board and the posts are of UHMW polyethelene, is by spin-welding, spinning the posts against the board until the material melts and bonds.

According to the foregoing description, an apparatus and method have been provided for transferring a patient from one patient support to another, wherein the two supports are level, or wherein they are at different heights, either raising the patient to a higher level, or lowering him down to a lower level.

Having described my invention in its preferred embodiment, I claim:

1. A patient transfer apparatus for facilitating the transfer of a patient lying on a first patient support to a substantially adjacent second patient support, the apparatus comprising in combination:

(a) a first patient support having a top surface on which the patient initially rests prior to being moved, and having side edges depending from the perimeter of the top surface thereof;

(b) a second patient support having a top surface on which the patient finally rests after being moved thereonto, and having side edges depending from the perimeter of the top surface thereof;

(c) a substantially rigid, planar board having a smooth and continuous upper surface and a length sufficient to support the majority of the weight of a patient between the shoulders and the hips, and a width sufficient to bridge between the first and second patient supports and bear on the top surfaces thereof; and (d) stop means secured to the bottom of the board comprising a plurality of posts attached to the bottom of the board in a line along the length thereof with some of said posts being adjacent each end of the board and at least one post being disposed therebetween, said posts extending downwardly from the board and having sufficient depth to bear against a side edge of the receiving second patient support to prevent movement of the board as the patient is slid across it, said posts being attached in such a position and being of such a width that they fit between the substantially adjacent patient supports, while leaving a sufficient amount of the board on each side to bear on the top surface of each respective patient support.

2. The apparatus of claim 1 wherein the posts are spin-welded to the board.

3. A method of transferring a patient in a lying position from the top surface of a first patient support to the top surface of a second patient support at a greater height, and having a patient transfer apparatus including a substantially rigid, planar board spanning the distance between the top surfaces of the patient supports, a stop on the bottom of the board engaging the second patient support below the top surface thereof, and a flexible sheet between the patient and the board, the method comprising:

(a) inserting the sheet beneath the patient so that an amount of the sheet sufficient for a handle extends on both sides of the patient;

(b) positioning the board at an incline to span the distance between the patient supports with the stop engaging the second patient support;

(c) moving the patient across the board by pulling on the side of the sheet nearest the higher patient support to slide the patient upwardly on the inclined board;

(d) supporting the side of the patient nearest the lower patient support by holding the sheet on that side substantially upright from the patient to the point where it is held;

(e) supporting the head and legs of the patient; and (f) removing the board and the sheet from under the patient when the patient is on the second support surface.

4. The method of claim 3 wherein the lower part of the inclined board which extends away from the second patient support surface tips upwardly, parallel with the second patient support surface, when the center of weight of the patient is pulled past the stop.

* * * * *